US009422791B2

(12) United States Patent
Plain

(10) Patent No.: US 9,422,791 B2
(45) Date of Patent: Aug. 23, 2016

(54) HEAVE COMPENSATION AND TENSIONING APPARATUS, AND METHOD OF USE THEREOF

(71) Applicant: ICON Engineering Pty Ltd., West Perth (AU)

(72) Inventor: Steven Plain, Burswood (AU)

(73) Assignee: ICON Engineering Pty Ltd, West Perth (AU)

( * ) Notice: Subject to any disclaimer, the term of this patent is extended or adjusted under 35 U.S.C. 154(b) by 509 days.

(21) Appl. No.: 13/892,020

(22) Filed: May 10, 2013

(65) Prior Publication Data

US 2014/0331908 A1 Nov. 13, 2014

(30) Foreign Application Priority Data

May 9, 2013 (AU) ..... 2013205798

(51) Int. Cl.
*E21B 19/00* (2006.01)
*E21B 41/00* (2006.01)
*B63B 35/44* (2006.01)

(52) U.S. Cl.
CPC ..... *E21B 41/0007* (2013.01); *B63B 35/4413* (2013.01); *E21B 19/006* (2013.01)

(58) Field of Classification Search
CPC ..... E21B 19/006; E21B 41/0007; B63B 35/4413
USPC ..... 166/355; 405/224.4
See application file for complete search history.

(56) References Cited

U.S. PATENT DOCUMENTS 3,718,316 A * 2/1973 Larralde et al. ..... 254/277
3,785,445 A * 1/1974 Scozzafava ..... 175/5
3,871,622 A * 3/1975 Larralde et al. ..... 254/392
3,902,319 A * 9/1975 Olmsted ..... 60/413
3,912,227 A * 10/1975 Meeker et al. ..... 254/271
4,382,361 A * 5/1983 Blanchet ..... E02F 3/88 37/310
4,506,591 A * 3/1985 Blanchet ..... E02F 3/88 91/396
4,759,256 A * 7/1988 Kovit et al. ..... 91/29
(Continued)

FOREIGN PATENT DOCUMENTS

WO 2007/139394 A1 12/2007
WO 2012/148289 A1 11/2012

OTHER PUBLICATIONS

UK Intellectual Property Office Combined Search and Exam Report for Application No. GB1407907.3 (5 pgs.), Oct. 14-15, 2014.

*Primary Examiner* — Matthew R Buck
(74) *Attorney, Agent, or Firm* — Fitch, Even, Tabin & Flannery LLP

(57) ABSTRACT

A heave compensation and tensioning apparatus for use on a floating vessel during "locked-to-bottom" operations is provided. The apparatus includes a pair of hydraulic cylinders that are fixed to a lower section of a frame. Respective free ends of piston rods of the hydraulic cylinders are operatively associated with an upper section of the frame. A pair of accumulators are in communication with pressure vessels and the cylinders using a pneumatic fluid line and a primary hydraulic fluid line, respectively. A control valve assembly allows the piston rods to retract or extend in response to, and to compensate for, heave of the floating vessel. An isolation valve can hydraulically lock the piston rods. In this way, the heave compensation and tensioning apparatus forms a rigid link and can be employed as a secondary or back-up heave compensator for a primary heave compensator.

12 Claims, 9 Drawing Sheets

(56) References Cited

U.S. PATENT DOCUMENTS

| | | | | |
|---|---|---|---|---|
| 4,964,491 | A * | 10/1990 | Dombrowski | F16F 13/00 188/280 |
| 7,231,981 | B2 * | 6/2007 | Moe et al. | 166/355 |
| 8,157,013 | B1 * | 4/2012 | Trent | 166/355 |
| 8,590,626 | B2 * | 11/2013 | Barone et al. | 166/355 |
| 2012/0267117 | A1 | 10/2012 | Skinnes | |
| 2014/0034329 | A1 * | 2/2014 | Skinnes et al. | 166/355 |
| 2015/0184470 | A1 * | 7/2015 | Megens et al. | 166/355 |

* cited by examiner

HEAVE COMPENSATION AND TENSIONING APPARATUS, AND METHOD OF USE THEREOF

TECHNICAL FIELD

A heave compensation and tensioning apparatus is disclosed for use on floating drilling vessels such as drilling ships and semi-submersible drilling vessels. Particularly, though not exclusively, a heave compensation and tensioning apparatus is disclosed for use as a primary heave compensator or back up to the rig's drill string compensator.

BACKGROUND

As oil and gas offshore exploration and production operations are increasingly established in deeper waters, it has become more common for drilling activities to be performed from rigs that float on the surface of the water, such as drilling vessels or semi-submersible drilling rigs. Unlike fixed rigs or jack-up rigs, floating rigs are subject to wave motion, causing up- and down motion, which must be compensated for during drill, well completions, well interventions and other operations. Wave motion is of particular concern during "locked-to-bottom" operations (i.e. well completion, well testing and well intervention) where a landing string is physically connected to the wellhead at the seabed. Loss of heave compensation can lead to severe consequences.

Apart from the operational difficulties arising from the up-and-down motion of the floating rig, significant safety issues also arise, in particular the potential for the landing string to fracture or buckle and cause a blowout. Indeed, safety standards in offshore operations demand that a heave compensation system be regarded as an essential component of a floating rig during locked-to-bottom operations.

Known heave compensation systems may be described as employing passive heave compensation or active heave compensation.

A simple passive heave compensator is a soft spring which effectively strokes in and out in response to string loads as the vessel heaves up and down while effectively holding constant tension on the string. Exemplary types of simple passive heave compensators are crown-mounted compensators or drill string compensators. Passive heave compensators employ hydraulic cylinders and associated gas accumulators to store and dissipate the wave energy.

Active heave compensation differs from passive heave compensation by having an externally powered control system that actively tries to compensate for any movement at a specific point. Exemplary types of active heave compensation include active heave draw works which employ electric or hydraulic winch systems to raise and lower the top drive in response to the vessel motion.

Active and passive heave compensation systems may be combined to provide semi-active heave compensation systems.

The essential nature of the heave compensation function to a floating rig is such that safety standards also demand that they be designed such that no single component failure shall lead to overall failure of the system. They should also be "fail to safety" meaning that in the event of any failure the system defaults to a compensating state, which is the safest state during locked-to-bottom operations. While active heave draw works have numerous benefits, they fail to a "locked condition". Safe operations and industry standards require additional means of safety to be implemented in the system/equipment configuration. Additional means of safety may include an in-line tensioner, design of a weak link in the riser/landing string, limiting operation parameters to be within the stretch limit of the riser, and so forth.

Generally, these operating parameters place constraints on operators which have direct impact on productivity and efficiency. All these existing options have limitations. In the case of an inline tensioner there are concerns about the how the inline tensioner behaves when run in series with the active heave draw works. In the case of the weak link in the riser, they typically only provide protection in an over-tensioned case and once broken, they provide no support to the landing string thereafter. In the case of limiting operating parameters to within the stretch of the riser, this can impose considerable downtime during offshore operations.

There is therefore a need for an alternative or improved heave compensation apparatus which may operate as a primary heave compensator or as a back-up to the rig's drill string compensator in the event of failure or disablement of the rig's drill string compensator.

There is also a need for an improved heave compensation apparatus which can be used as a lift frame for the installation of pressure control equipment during well testing/well intervention work, as those components are installed in the congested space of the drilling derrick.

The above references to background art do not constitute an admission that the art forms a part of the common general knowledge of a person of ordinary skill in the art. The above references are also not intended to limit the application of the heave compensation and tensioning apparatus as disclosed herein.

SUMMARY

Generally, a heave compensation and tensioning apparatus, and a method of use thereof, is disclosed. The heave compensation and tensioning apparatus may be employed as a primary heave compensation and tensioning apparatus or as back-up to the rig's primary compensator in the event of failure or disablement of the rig's primary compensator. The primary compensator may be in the form of a drill string compensator. According to one aspect, there is disclosed a heave compensation and tensioning apparatus for a floating vessel, said apparatus comprising:

- one or more cylinders, the one or more cylinders having a respective piston head and a piston rod therein, a free end of the one or more piston rods being operatively associated with a top drive system of the floating vessel and a fixed end of the one or more cylinders being fixed relative to a flowhead assembly;
- one or more piston accumulators;
- a primary hydraulic fluid line interconnecting the one or more piston accumulators and the one or more cylinders;
- a control valve assembly arranged to control fluid flow through the primary hydraulic fluid line and thereby retract or extend the one or more piston rods in response to, and to compensate for, heave of the floating vessel, the control valve assembly further comprising an isolation valve capable of locking the one or more piston rods at any point along their respective stroke path, thereby forming a rigid link between the top drive system and the flowhead assembly when said apparatus is operated as a back up to a primary compensator;
- the primary hydraulic fluid line being further provided with a bypass fluid flowpath comprising a first bypass line and a second bypass line, each bypass line being configured to bypass the isolation valve, whereby the control valve assembly is configured to redirect fluid flow through the first bypass line when pressure in the cylinder exceeds an upper pressure threshold and through the second bypass line when pressure in the cylinders falls below a lower pressure threshold, thereby allowing the apparatus to continue to compensate for heave of the floating vessel.

In one embodiment said heave compensation and tensioning apparatus for a floating vessel comprises:

a frame having an upper section adapted for attachment to a top drive system and a lower section adapted to interface with a flowhead assembly;

a pair of cylinders fixed to the lower section of the frame, each cylinder having a piston head and a piston rod therein, a free end of the piston rod being operatively associated with the upper section of the frame;

a pair of piston accumulators;

a primary hydraulic fluid line interconnecting the piston accumulators and the cylinders;

a control valve assembly arranged to control fluid flow through the primary hydraulic fluid line and thereby retract or extend the piston rods in response to, and to compensate for, heave of the floating vessel, the control valve assembly further comprising an isolation valve capable of locking the piston rods at any point along their respective stroke path, thereby forming a rigid link between the flowhead assembly and the top drive system when said apparatus is operated as a back up to a primary compensator;

the primary hydraulic fluid line being further provided with a bypass fluid flowpath comprising a first bypass line and a second bypass line, each bypass line being configured to bypass the isolation valve, whereby the control valve assembly is configured to redirect fluid flow through the first bypass line when pressure in the cylinders exceeds a upper pressure threshold and through the second bypass line when pressure in the cylinders falls below a lower pressure threshold, thereby allowing the apparatus to continue to compensate for heave of the floating vessel.

In another embodiment said heave compensation and tensioning apparatus for a floating vessel comprises:

a frame having an upper section and a lower section adapted to interface with a flowhead assembly;

a cylinder fixed to the upper section of the frame, the cylinder having a piston head and a piston rod therein, a free end of the piston rod being adapted for attachment to a top drive system;

a piston accumulator;

a primary hydraulic fluid line interconnecting the piston accumulator and the cylinder;

a control valve assembly arranged to control fluid flow through the primary hydraulic fluid line and thereby retract or extend the piston rod in response to, and to compensate for, heave of the floating vessel, the control valve assembly further comprising an isolation valve capable of locking the piston rod at any point along its respective stroke path, thereby forming a rigid link between the top drive system and the flow head assembly when said apparatus is operated as a back up to a primary compensator;

the primary hydraulic fluid line being further provided with a bypass fluid flowpath comprising a first bypass line and a second bypass line, each bypass line being configured to bypass the isolation valve, whereby the control valve assembly is configured to redirect fluid flow through the first bypass line when pressure in the cylinder exceeds a upper pressure threshold and through the second bypass line when pressure in the cylinder falls below a lower pressure threshold, thereby allowing the apparatus to continue to compensate for heave of the floating vessel.

Where the isolation valve is closed unintentionally, consequently hydraulically locking the system, the apparatus will automatically revert to a compensating state. Further, in embodiments where the apparatus comprises a back up to the primary compensator, the apparatus is adapted to rapidly activate and provide compensation if the primary compensator fails.

In one embodiment the piston accumulator comprises a cylinder barrel having a hydraulic chamber and a pneumatic chamber defined therein, wherein the pneumatic chamber is in communication with a pneumatic pressure vessel via a pneumatic fluid line. The primary hydraulic fluid line may interconnect the hydraulic chambers of the piston accumulators and the cylinders.

In another embodiment the primary hydraulic fluid line may be further provided with an anti-recoil valve having a restricted flow path, whereby under sudden loss of load the anti-recoil valve is configured to close to a restricted opening, limiting the maximum flow of hydraulic fluid from the piston accumulator(s) to the cylinder(s). In further embodiments, the restricted flow path may be provided in a further bypass line. Sudden loss of load may be indicated by a vertical acceleration of the frame. The valve may be triggered to close when the frame velocity exceeds the maximum normal operating heave velocity.

The disclosure also describes a method of activating a back-up compensator to provide heave compensation for a floating vessel equipped with a primary compensator when said primary compensator fails, the method comprising:

providing the back-up compensator according to the first aspect as defined above;

locating the one or more cylinders of the back-up compensator between the top drive system and the flow head assembly in a manner whereby the free ends of the piston rods are operatively associated with the top drive system and the fixed ends of the cylinders are fixed relative to the flow head assembly;

locking the isolation valve of the back-up compensator to form a rigid link between the top drive system and the flow head assembly;

when said primary compensator fails thereby causing the pressure in the one or more cylinders to exceed an upper pressure threshold or fall below a lower pressure threshold, redirecting fluid flow to bypass the locked isolation valve via the first bypass line or the second bypass line, respectively; and, allowing the piston rods of the one or more cylinders to retract or extend in response to, and to compensate for, heave of the floating vessel.

It will be appreciated that there are load and space constraints in installing compensators into the drill derrick. In respect of heave compensators employing hydraulic cylinders, respective low pressure air accumulators in fluid communication with the blind side of the cylinders are generally provided to accommodate fluctuation in the gas pressure of the blind side of the cylinder when the piston rod of the cylinder retracts or extends in response to, and to compensate for, heave of the floating vessel. The heave compensation and tensioning apparatus described herein provides an apparatus where such additional low pressure air accumulators are redundant, thereby resulting in a reduced weight and footprint in comparison with prior art heave compensators.

Accordingly, there is disclosed a heave compensation and tensioning apparatus for a floating vessel, said apparatus comprising one or more cylinders having a respective piston head and piston rod therein, wherein each piston rod is hollow and in fluid communication with a respective blind side of each respective cylinder via an aperture in the piston head, the hollow piston rod thereby defining a low pressure air accumulator therein to accommodate fluctuation in gas pressure in the blind side of the cylinder when the piston rod retracts or extends in response to, and to compensate for, heave of the floating vessel.

A hydraulic cylinder for use in a heave compensating and tensioning apparatus for a floating vessel, the cylinder having a piston rod and a piston head therein, a free end of the piston rod capable of being operatively associated with a fixed point on the floating vessel, wherein each piston rod is hollow and in fluid communication with a respective blind side of each respective cylinder via an aperture in the piston head, the hollow piston rod thereby defining a low pressure air accumulator therein to accommodate fluctuation in gas pressure in the blind side of the cylinder when the piston rod retracts or extends in response to, and to compensate for, heave of the floating vessel.

The disclosure also provides a method of compensating for heave of a floating vessel, the method comprising:

providing a heave compensation apparatus comprising:

one or more cylinders, each cylinder having a respective piston rod and piston head, a free end of the one or more piston rods being operatively associated with a top drive system of the floating vessel and a fixed end of the one or more cylinders being fixed relative to a flowhead assembly;

wherein each piston rod is hollow and in fluid communication with a respective blind side of each respective cylinder via an aperture in the piston head, the hollow piston rod thereby defining a gas accumulator therein to accommodate fluctuation in gas pressure in the blind side of the cylinder when the piston rod retracts or extends in response to, and to compensate for, heave of the floating vessel;

locating the one or more cylinders between the top drive system and the flowhead assembly in a manner whereby the free ends of the piston rods are operatively associated with the top drive system and the fixed ends of the cylinders are fixed relative to the flow head assembly; and, allowing the piston rods of the cylinders to retract or extend in response to, and to compensate for, heave of the floating vessel.

DESCRIPTION OF THE FIGURES

Notwithstanding any other forms which may fall within the scope of the apparatus as set forth in the Summary, specific embodiments will now be described, by way of example only, with reference to the accompanying drawings in which.

DETAILED DESCRIPTION OF SPECIFIC EMBODIMENTS

Embodiments of a heave compensation and tensioning apparatus for a floating vessel will now be described by way of example only, and with particular (though not exclusive) reference to drilling for oil and gas reserves offshore.

Figure 1:
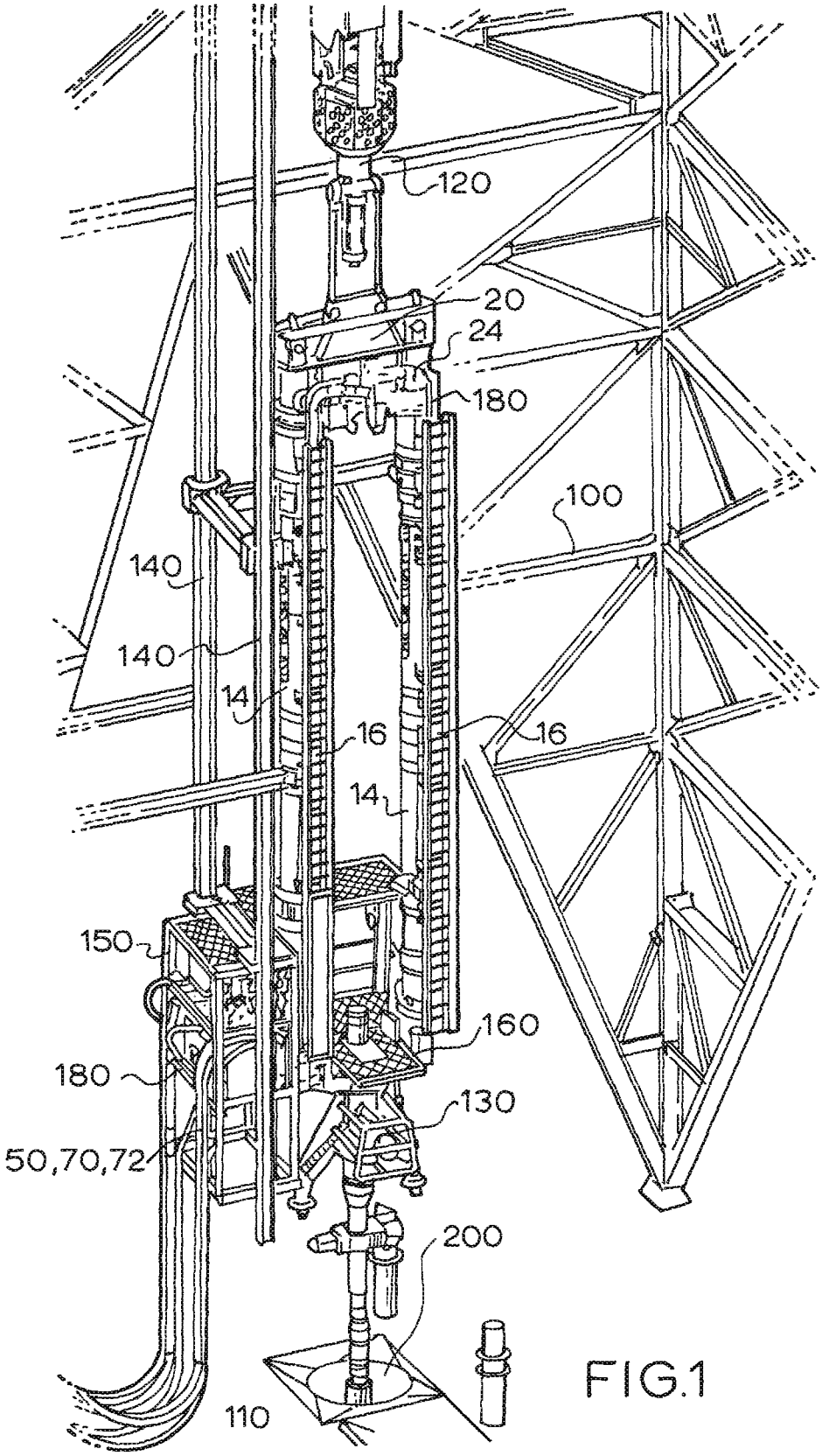
FIG. 1 is a partial schematic representation of a derrick and drill floor of a floating vessel showing a heave compensation and tensioning apparatus in accordance with one embodiment configured in-line with various components used in locked-to-bottom operations for oil and gas reserves offshore.
Figures 2, 2A:
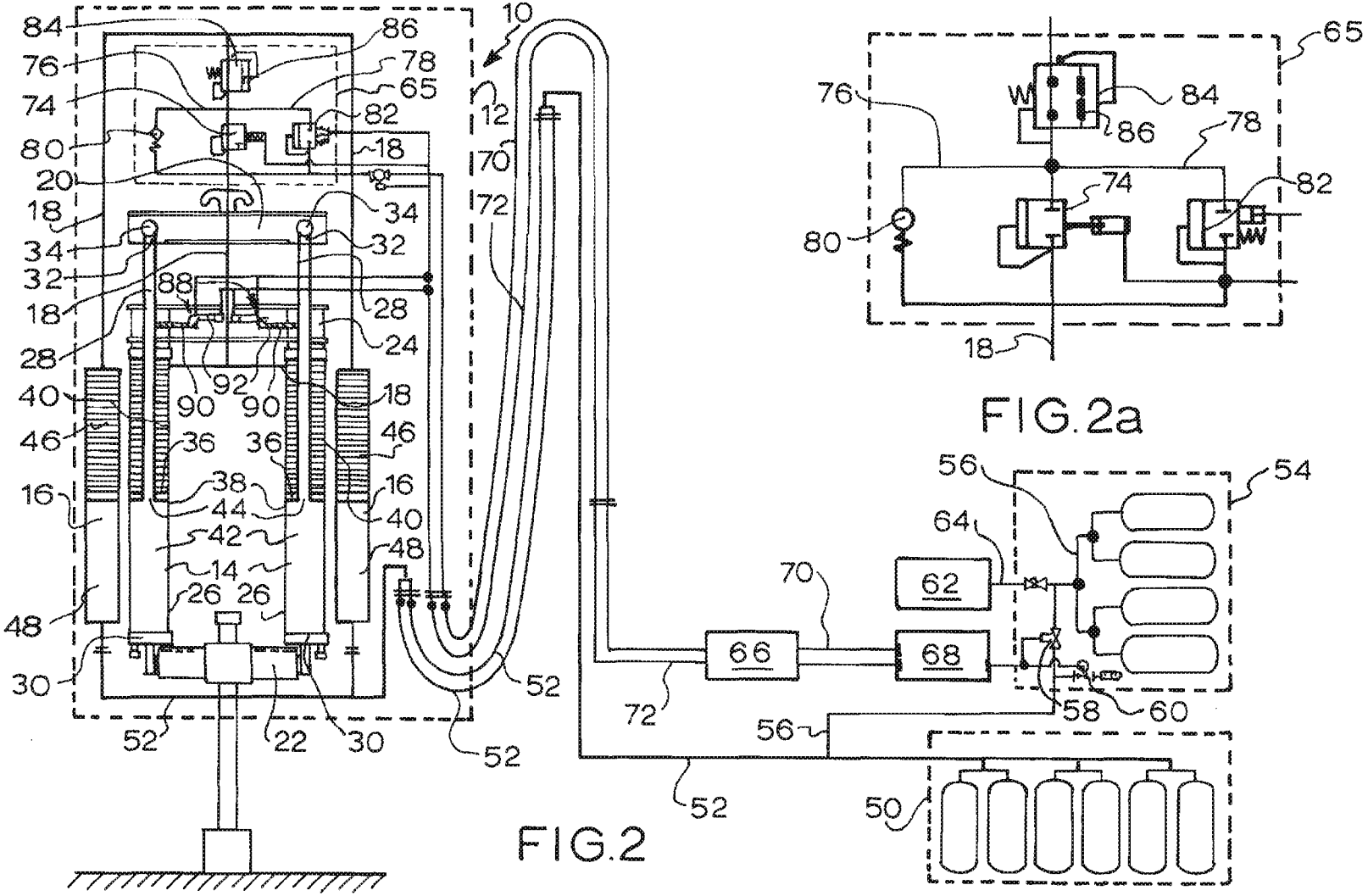
FIG. 2 is a schematic representation of a heave compensation and tensioning apparatus for a floating vessel in accordance with the disclosure, wherein the piston rods of said apparatus are shown in mid-stroke.
FIG. 2*a* is a schematic representation of the heave compensating and tensioning apparatus for a floating vessel, wherein the apparatus is hydraulically locked.

Referring to FIG. 1 there is shown a partial and schematic view of a derrick 100 and a drill floor 200 of a floating vessel used in locked-to-bottom operations for oil and gas production offshore. The derrick 100 extends upwardly above the drill floor 200 and supports the main hoisting and drilling components used in drilling operations.

The derrick 100 may support a hoisting assembly, such as a block and tackle, for raising and lowering a landing string 110 which may be configured to pass through the drill floor 200 and facilitate well testing/well intervention of a subsea production well. A lower end of the landing string 110 may be fixed to the wellhead at the seafloor by means of a tubing hanger in what may be termed 'locked-to-bottom' operations. A top drive system 120 may be provided to also facilitate lowering or lifting of the landing string 110 into or out of the wellbore. Fluid produced at the wellhead may be directed through a riser to a flowhead assembly 130 located above the drill floor 200 and thence directed to well testing/processing facilities located elsewhere topside.

The hoisting assembly may be provided with a primary heave compensation system. The primary heave compensation system may be an active heave drawworks system or a passive heave compensator mounted on the top of the derrick 100. As discussed above, if this primary heave compensation system fails or becomes inoperative, the fluctuation in the vertical position of the floating vessel relative to the seafloor due to wave motion will place the landing string 110 under alternating compression and tension.

Accordingly, the heave compensating and tensioning apparatus 10, in the embodiment described herein, provides a back-up or secondary heave compensation system. Alternatively, the apparatus 10 can operate as the primary heave compensation system. The heave compensating and tensioning apparatus 10 may be configured in-line below the rig's primary heave compensation system. Said apparatus 10 may be operatively associated at one end thereof with the top drive system 120 and fixed at an opposing end thereof to the flowhead assembly 130. Installed in this way, the heave compensating and tensioning apparatus 10 may be suspended above the drill floor 200 of the floating vessel.

As described in the embodiment herein, the heave compensating and tensioning apparatus 10 may be additionally supported by an upper dolly track 140 and a lower guide frame 150 engaged with dolly tracks in the derrick 100. The lower guide frame 150 may also be adapted to provide a deck 160 on which to house a plurality of winches, including a dedicated man-riding winch to provide operator access to said apparatus 10, thereby reducing access difficulties due to relative motion between drill floor and said apparatus 10. It will be appreciated that the derrick 100 may also support a plurality of umbilicals 180 for conveying pneumatic fluid, hydraulic fluid, electrical power, and control signals to said apparatus 10.

In normal inline operation, the heave compensating and tensioning apparatus 10 may be disposed in 'locked' mode, as will be described later, so that the primary heave compensation system accounts for the heave of the floating vessel. In the event of failure of the primary heave compensation system, however, the heave compensating and tensioning apparatus 10 may be automatically actuated to provide primary heave compensation for the floating vessel.

Referring generally to FIGS. 2 to 6, where like reference numerals refer to like parts throughout, there is shown the heave compensating and tensioning apparatus 10 as described herein.

The apparatus 10 includes a frame 12, a pair of cylinders 14 in the form of hydraulic cylinders, and a pair of piston accumulators 16 in operative communication with the pair of cylinders 14 via a primary hydraulic line 18.

The frame 12, which will be described later in more detail with reference to FIGS. 7-9, includes an upper section 20 adapted for attachment to the top drive system 120 and a lower section 22 adapted to interface with the flowhead assembly 130. The frame 12 also includes an intermediate section 24 for providing rigid structural support for the pair of cylinders 14.

Each cylinder 14 includes a cylinder barrel 26 and a piston rod 28 telescopically translatable within the cylinder barrel 26. In some embodiments, the piston rod may have a stroke of up to 10 m or more which enables the apparatus 10 to compensate for both vessel heave and tide without the need to adjust the drawworks elevation from the drill floor 200.

A lower end 30 of the cylinder barrel 26 is mounted to the lower section 22, as will be described in more detail with reference to FIG. 8.

The piston rod 28 has a free end 32 with a clevis 34 associated therewith. In use, the clevis 34 of each piston rod 28 is operatively associated with the upper section 20 of the frame 12, as will be described in more detail with reference to FIG. 7.

An opposing end 36 of the piston rod 28 is associated with a piston head 38. In use, the piston head 38 is translatable within the cylinder barrel 26, thereby defining a hydraulic chamber 40 that is filled with hydraulic fluid and a 'blind' chamber 42 that is filled with air. The 'blind' chamber 42 is commonly referred to as the blind side of the cylinder 14.

In one particular embodiment, the piston rod 28 may be hollow and in fluid communication with the blind chamber 42 of the cylinder 14 via an aperture 44 in the piston head 38. In this configuration, the hollow piston rod may define a low pressure air accumulator therein to accommodate fluctuation in gas pressure in the blind chamber 42 of the cylinder 14 when the piston rod 28 retracts, or extends in response to, and to compensate for, heave of the floating vessel. Advantageously, this embodiment eliminates the need for low pressure gas accumulators disposed in fluid communication with the blind side of the cylinder 14, thereby reducing the weight and footprint of the apparatus 10 in comparison with prior art compensators.

Each piston accumulator 16 includes a hydraulic chamber 46 and a pneumatic chamber 48. The hydraulic chamber 46 is filled with hydraulic fluid and is in operative communication with the corresponding hydraulic chamber 40 of the cylinder 14 via the primary hydraulic fluid line 18.

The pneumatic chamber 48 is in communication with a pneumatic pressure vessel 50 via a pneumatic fluid line 52.

In some embodiments the pneumatic pressure vessel 50 may comprise a plurality of air pressure vessels (APV). Each APV may be 1-2 kL, preferably having pressure greater than 100 bar, even more preferably having pressure greater than 200 bar. The pneumatic pressure vessel 50 may operate as a passive 'spring' in the heave compensation and tensioning apparatus 10 by storing and dissipating the energy associated with wave motion.

The pneumatic pressure vessel 50 may be in fluid communication with an air pressure charging module 54 via line 56. The air pressure charging module 54 comprises additional high pressure air storage to adjust the pressure of the apparatus 10 when required (e.g. increase pneumatic pressure to compensate for increased hook load). High pressure air fill valve 58 is provided on line 56 and may be opened to increase air pressure to account for increased hook load. Conversely, high pressure air vent valve 60 is also provided on line 56 and may be opened to decrease air pressure to account for decreased hook load. The air pressure charging module 54 is typically at a higher pressure than (up to 150-200%) the pneumatic pressure vessel 50. For example, if the pneumatic pressure vessel 50 is at 210 bar, the air pressure charging module 54 may be at 345 bar.

A compressor 62, in the form of a high pressure air compressor, may also be provided to supply clean dry high pressure air to initially pressurise the entire apparatus 10 or to charge the air pressure charging module 54 via line 64. Advantageously, the compressor 62 allows the apparatus 10 to be operated independently from any other high pressure air supply system of the floating vessel.

The air pressure charging module 54 is arranged to provide prompt adjustment of air pressure and loads to account for sudden changes in string weight without having to solely rely on the compressor 62.

Advantageously, the pneumatic pressure vessel 50, the air pressure charging module 54 and the compressor 62 may be disposed on a separate deck, for example in a non-hazardous safe zone.

The apparatus 10 further comprises a control valve assembly 65. The control valve assembly 65 is arranged to control the flow of hydraulic fluid through the primary hydraulic fluid line 18 and thereby retract or extend the piston rods 28 in response to, and to compensate for, heave of the floating vessel. The control valve assembly 65 may be controlled from a control panel 66. Preferably, the control panel 66 is disposed and operated from the drill floor 200, thereby enabling the apparatus 10 to be operated remotely from the drill floor 200 without the need to directly access the apparatus 10.

Further the primary hydraulic fluid line 18 may be charged with hydraulic fluid from a hydraulic power unit 68 via fill and drain lines 70 and pilot lines 72.

The control valve assembly 65 comprises an isolation valve 74 capable of preventing fluid flow though the primary hydraulic fluid line 18. The isolation valve 74 is operable to lock the piston rods 28 at any point along their respective stroke path, thereby forming a rigid link between the upper and lower sections 20, 22 of the frame 12. Hydraulically locking the isolation valve 74 enables the apparatus 10 to be employed in-line with and back-up to a rig's drill string compensator, such as a crown mounted compensator or an active heave draw works, as described previously.

The primary hydraulic fluid line 18 may be further provided with a bypass fluid flowpath comprising a first bypass line 76 and a second bypass line 78. Each bypass line 76, 78 is configured to bypass the isolation valve 74, thereby allowing flow of hydraulic fluid through the primary hydraulic fluid line 18 between the accumulators 16 and the cylinders 14.

Figure 5:
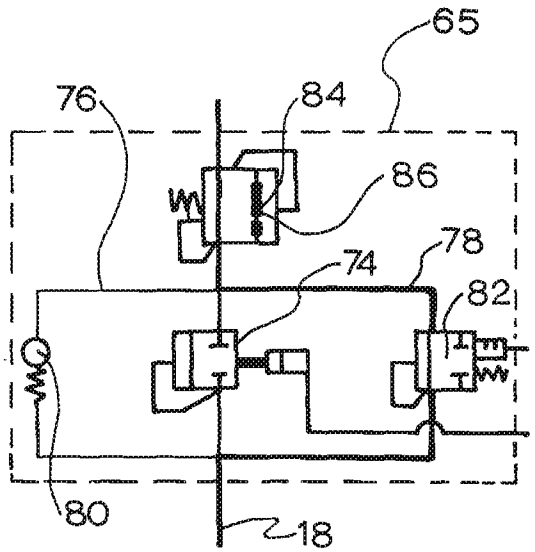
FIG. 5 is a schematic representation of the heave compensating and tensioning apparatus, showing re-direction of fluid flow through a second bypass line on a down heave.

The first bypass line 76 is provided with a bypass relief valve 82, in the form of a non-reclosing pressure dump valve. As shown in FIG. 5, bypass relief valve 82 is configured to redirect fluid flow through the first bypass line 78 when pressure in the cylinders 14 exceeds an upper pressure threshold. The upper pressure threshold may be greater than 200 bar (e.g. 220 bar). The upper pressure threshold is determined and set such that the bypass relief valve 82 will trigger before exceeding the allowable stress in the landing string.

Figure 4:
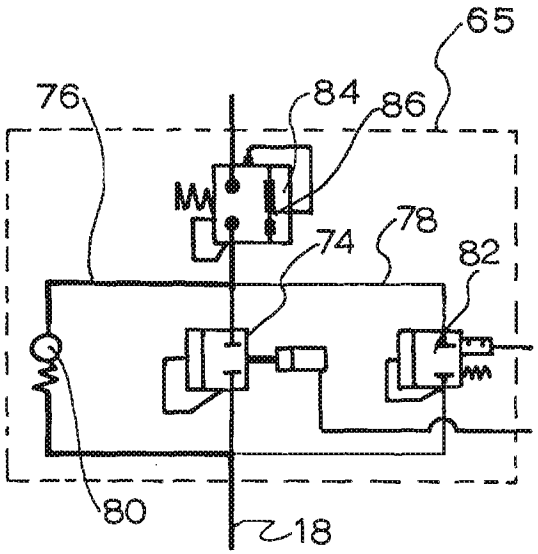
FIG. 4 is a schematic representation of the heave compensating and tensioning apparatus, showing re-direction of fluid flow through a first bypass line on an up heave.

The second bypass line 76 is provided with a bypass check valve 80, in the form of a cartridge style check valve. As shown in FIG. 4, bypass check valve 80 is configured to redirect fluid flow through the second bypass line 76 when pressure in the cylinders 14 falls below a lower pressure threshold. The lower pressure threshold may be less than 50 bar (e.g. 15 bar) below the nominal system pressure. The lower pressure threshold is set to limit the amount of compression applied at the well head.

In this way, in the event of failure or malfunction of the rig's drill string compensator, where pressure exceeds the upper pressure threshold or falls below the lower pressure threshold, the control valve assembly is configured to redirect fluid flow through the first or second bypass lines 78, 76, respectively, thereby allowing the apparatus 10 to automatically activate and provide ongoing heave compensation for the floating vessel. The bypass relief valve 82 and bypass check valve 80 are configured to activate rapidly, enabling the apparatus 10 to provide full heave compensation while not exceeding the allowable stress in the landing string 110. The activation speed may be less than 100 milliseconds.

Figure 6:
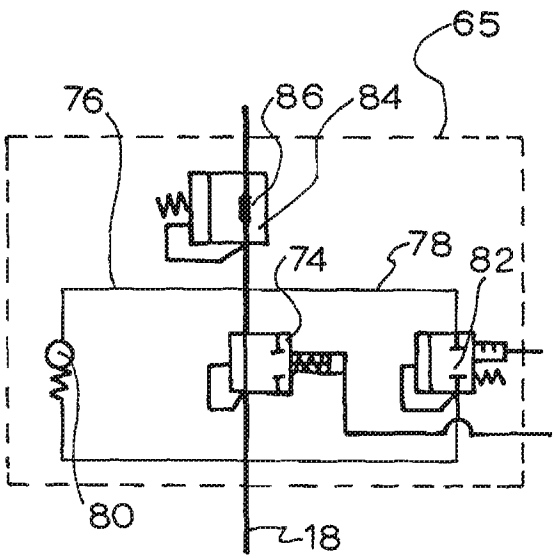
FIG. 6 is a schematic representation of the heave compensating and tensioning apparatus, showing constriction of fluid flow in the event of a sudden loss of load.

The primary hydraulic fluid line 18 may be further provided with an anti-recoil valve 84, in the form of a flow shut off valve, incorporating a restricted flowpath 86 therethrough. In an alternative embodiment, the flow shut off valve 84 may have a further bypass line with a flow restricted path (not shown). Under normal operating conditions the anti-recoil valve 84 is open. However, to safeguard against uncontrolled recoil resulting from sudden loss of load (e.g. parting of the drilling string or landing string) below the apparatus 10, the valve 84 is configured to close to restrict the flow of hydraulic fluid from the accumulators 16 to the cylinders 14, thereby preventing uncontrolled recoil. Uncontrolled recoil may be indicated by a cylinder velocity exceeding that of the normal operating heave which triggers the flow shut-off valve 84 to close rapidly in less than 100 ms. As shown in FIG. 6, closure of the flow shut-off valve 84 redirects flow of hydraulic fluid through an internal restricted flow path 86, thereby allowing the piston rods 28 to retract in a controlled fashion if there is a loss of load below the apparatus 10. This feature also ensures that the landing string is not overstressed if the flow shut-off valve 84 is unintentionally closed.

In addition, or as an alternative, to hydraulically locking the piston rods 28, the piston rods may be mechanically locked with a mechanical locking mechanism 88. In some embodiments the mechanical locking mechanism 88 may comprise a slidable locking pin 90 adapted to engage the clevis 34 of the piston rods 28 when they are in a fully retracted position. The slidable locking pin 90 is actuated by an associated cylinder 92 which urges the locking pin 90 to engage or disengage the clevis 34. The mechanical locking mechanism 88 may be controlled by the control panel 66.

Figure 7:
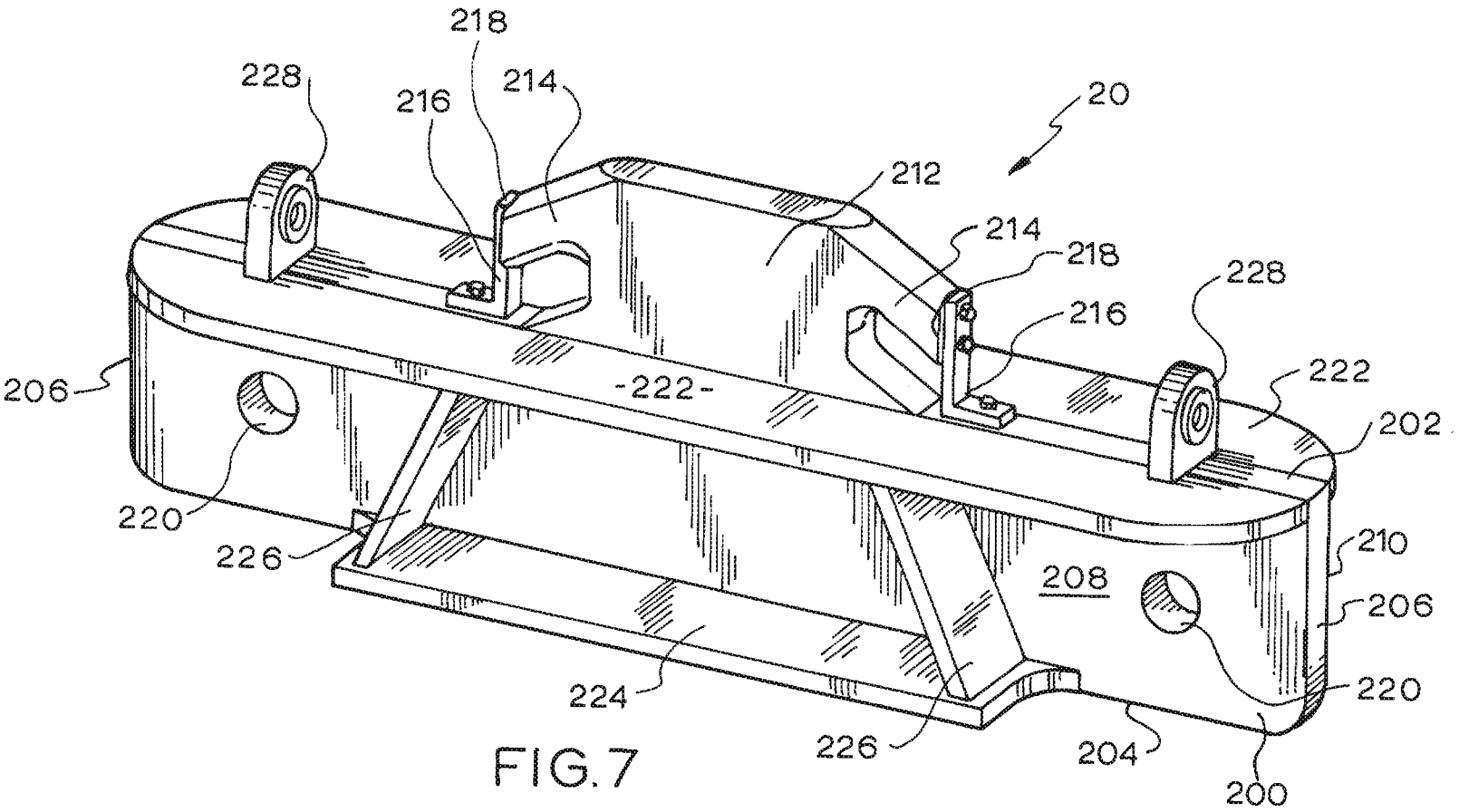
FIG. 7 is a perspective view of an upper section of a frame of said apparatus shown in FIGS. 1-6.

Referring now to FIG. 7, there is shown a detailed perspective view of the upper section 20 of the frame 12 of the heave compensating and tensioning apparatus 10. The upper section 20 is adapted for attachment to the top drive system 120 via elevator links.

The upper section 20 comprises a cross member 200 in the form of a spreader beam. The cross member 200 may be a plate having an upper edge 202, a lower edge 204, opposing side edges 206, a front side 208 and a rear side 210.

The upper section 20 further comprises an attachment member 212 in the form of a lug. In this embodiment, the attachment member upwardly extends from the upper edge 202 of the cross member 200 and is disposed substantially equidistantly from the opposing side edges 206 of the cross member 200. The attachment member 212 may be integrally formed with the cross member 200 or may be welded to the cross member 200.

The attachment member 212 may be configured to be coupled to the top drive system 120 by various couplers, such as bail arms or elevator links. In this embodiment, the attachment member 212 is provided with a pair of downwardly inclined ears 214 spaced from the upper edge 202 of the cross member 200. In use, as shown in FIG. 1, respective lower ends of the bail arms are engaged with the downwardly inclined ears 214 while respective upper ends of the bail arms are coupled to the top drive system 120.

In one particular embodiment, maintaining engagement of the lower ends of the bail arms with the downwardly inclined ears 214 may be achieved with a retainer 216 in the form of an L-shaped bracket. In use, after engagement of the bail arms with the downwardly inclined ears, the arms of the L-shaped bracket may be connected (such as with bolts, threaded screws, and so forth), respectively, to the upper edge 202 of the cross member 200 and side edge 218 of the downwardly inclined ears 214. In this way, if there is a recoil event or the load decreases, the lower ends of the bail arms are prevented from disengaging the downwardly inclined ears 214 and, consequently, the heave compensating and tension apparatus 10 is prevented from detaching from the top drive system 120.

The upper section 20 of the frame 12 is also adapted to be operatively associated with the piston rods 28 of the cylinders 14. The cross member 200 may be provided with a pair of apertures 220. Each aperture 220 is spaced apart from opposing side edges 206 of the cross member 200. The apertures 220 are configured, in use, to receive a pin which is inserted through a respective clevis 34 associated with the free end 32 of the piston rod 28 of the cylinder 14, thereby fixing the free end 32 of the piston rod 28 to the upper section 20 of the frame 12.

The upper section 20 may also comprise a first pair of opposing plates 222 laterally extending from the front and rear sides 208, 210 of the cross member 200 and a second pair of opposing plates 224 laterally extending from the front and rear sides 208, 210 of the cross member 200. The first pair of opposing plates 222 is disposed adjacent to the upper edge 202 of the cross member 200. The second pair of opposing plates 224 is disposed adjacent to the lower edge 204 of the cross member 200. A plurality of angled brace members 226 may be provided between the first and second pairs of plates 220, 222 to provide additional strength and rigidity to the upper section 20.

The upper section 20 of the frame may be further provided with a pair of load bearing lugs 228 in the form of padeyes. The load bearing lugs 228 are spaced apart from opposing side edges 206 of the cross member 200 and extend upwardly from the upper edge 202 of the cross member and the first pairs of laterally extending plates 220. The load bearing lugs 228 may be disposed in substantially vertical alignment with apertures 220 in the cross member 200. The load bearing lugs 228 may be capable of bearing the complete self weight of the frame 12 (e.g. a load of up to 10 tonne, preferably up to 50 tonne, and even more preferably greater than 50 tonne).

Figure 8:
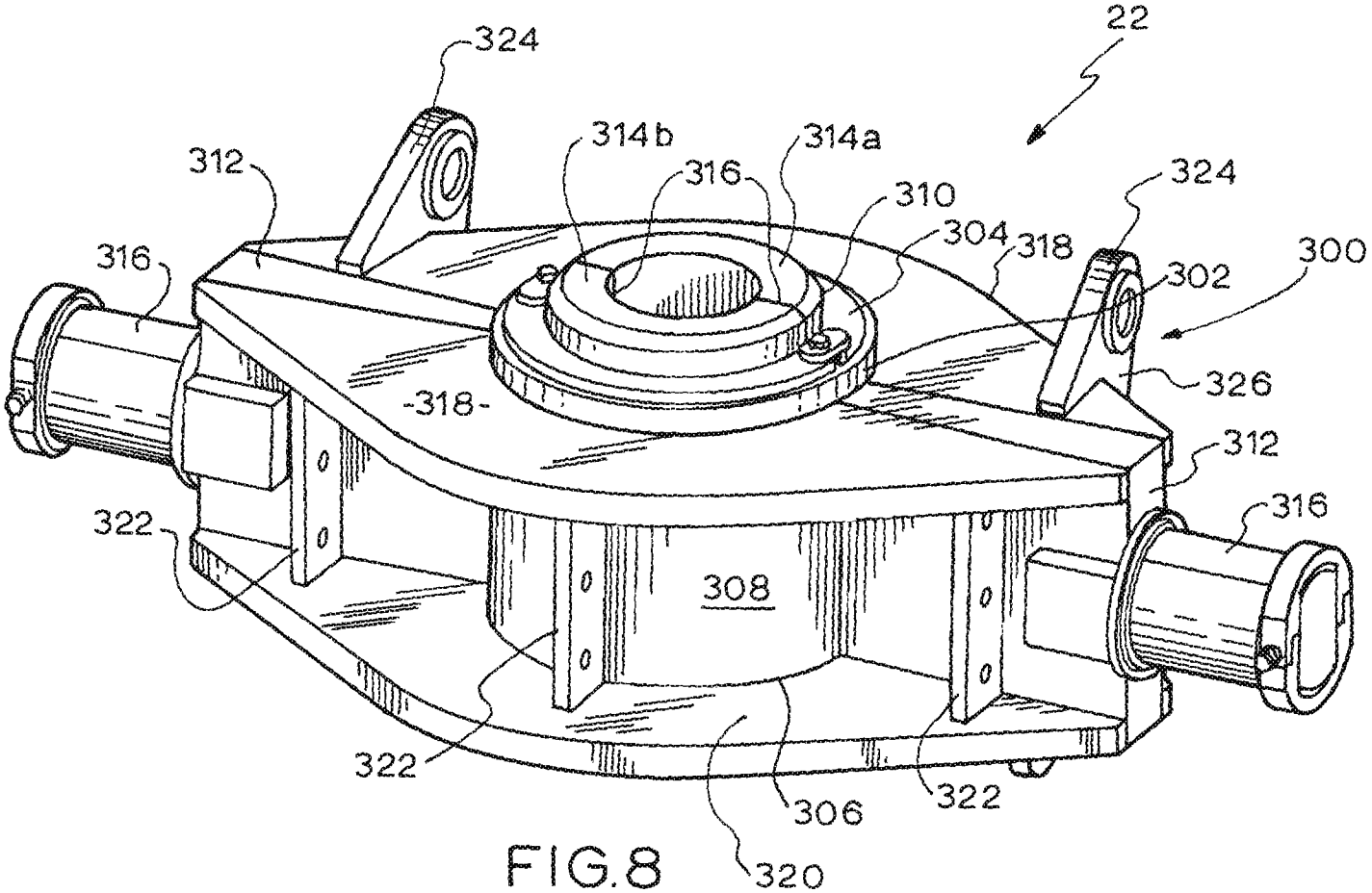
FIG. 8 is a perspective view of lower section of the frame of said apparatus shown in FIGS. 1-6.

Referring now to FIG. 8, there is shown a detailed perspective view of the lower section 22 of the frame 12 of the heave compensating and tensioning apparatus 10.

The lower section 22 comprises a cross member 300 in the form of a spreader beam. The cross member 300 comprises a cylindrical member 302 having an upper edge 304, a lower edge 306, an outer cylindrical wall 308, and an inner cylindrical wall 310.

The lower section 22 also comprises a pair of opposing side plates 312 outwardly extending from respective opposing sides of the outer cylindrical wall 308. The side plates 312 may be outwardly tapering.

The lower section 22 further comprises a pair of split insert members 314 which are locked in place by a collar members 304. The split insert members 314 comprises a pair of semi-cylindrical members 314*a*, 314*b* which are disposed to abut each other at facing edges 316 thereof. The cylindrical members 314*a*, 314*b* are concentrically disposed to abut the inner cylindrical wall 310 of the cylindrical member 302. The pair of split inserts is advantageously formed to interface with any one of a plurality of general flowhead assemblies 130. The collar members 304 are advantageously formed with a wedge type cross section, holding the split inserts 314 securely with the cylindrical member 302 in tension without the need for additional securing bolts.

In use, the flowhead assembly 130 is interfaced with the lower section 22 by coupling the flowhead assembly 130 with the split inserts 314 and the collar member 304 proximal to the lower edge 306 of the cylindrical member 302. In this way, the lower section 22 is capable of locking directly to the flowhead assembly 130 which has the advantage of optimising the stack-up height of the apparatus 10.

The lower section 22 of the frame 12 may be also adapted to engage the cylinders 14. The cross member 300 may be provided with a pair of opposing shafts 316. The shafts 316 outwardly extend from the opposing side plates 312 in longitudinal alignment therewith. In use, the shafts 316 are configured to engage the spherical bearings in the lower end 30 of the cylinders 14 in a manner whereby the cylinders 14 are fixed to the lower section 22 of the frame 12.

The lower section 22 may also comprise a first pair of opposing plates 318 laterally extending from the cylindrical member 302 and the side plates 312 of the cross member 300 and a second pair of opposing plates 320 laterally extending from the cylindrical member 302 and the side plates 312 of the cross member 300. The first pair of opposing plates 318 is disposed adjacent to the upper edge 304 of the cylindrical member 302. The second pair of opposing plates 320 is disposed adjacent to the lower edge 306 of the cylindrical member 302. A plurality of substantially vertical brace members 322 may extend between the first and second pairs of plates 318, 320 to provide additional strength and rigidity to the lower section 22 and to provide additional handling points. The vertical brace members 322 may be equidistantly spaced with respect to one another.

The lower section 22 of the frame 12 may be further provided with a pair of load bearing lugs 324 in the form of padeyes. The load bearing lugs 324 upwardly extend from the first pair of opposing plates 318. The load bearing lugs 324 may be integrally formed with substantially vertical brace members 326 extending between the first and second pairs of opposing plates 318, 320. The load bearing lugs 324 and the vertical brace members 326 are equidistantly spaced apart from opposing sides of the cross member 300. Advantageously, the load bearing lugs 324 may be used to lift the frame 12.

The lower section 22 may be further provided with one or more further load bearing lugs 328, in the form of padeyes, downwardly depending from an underside of the side plates 312.

Figure 9A:
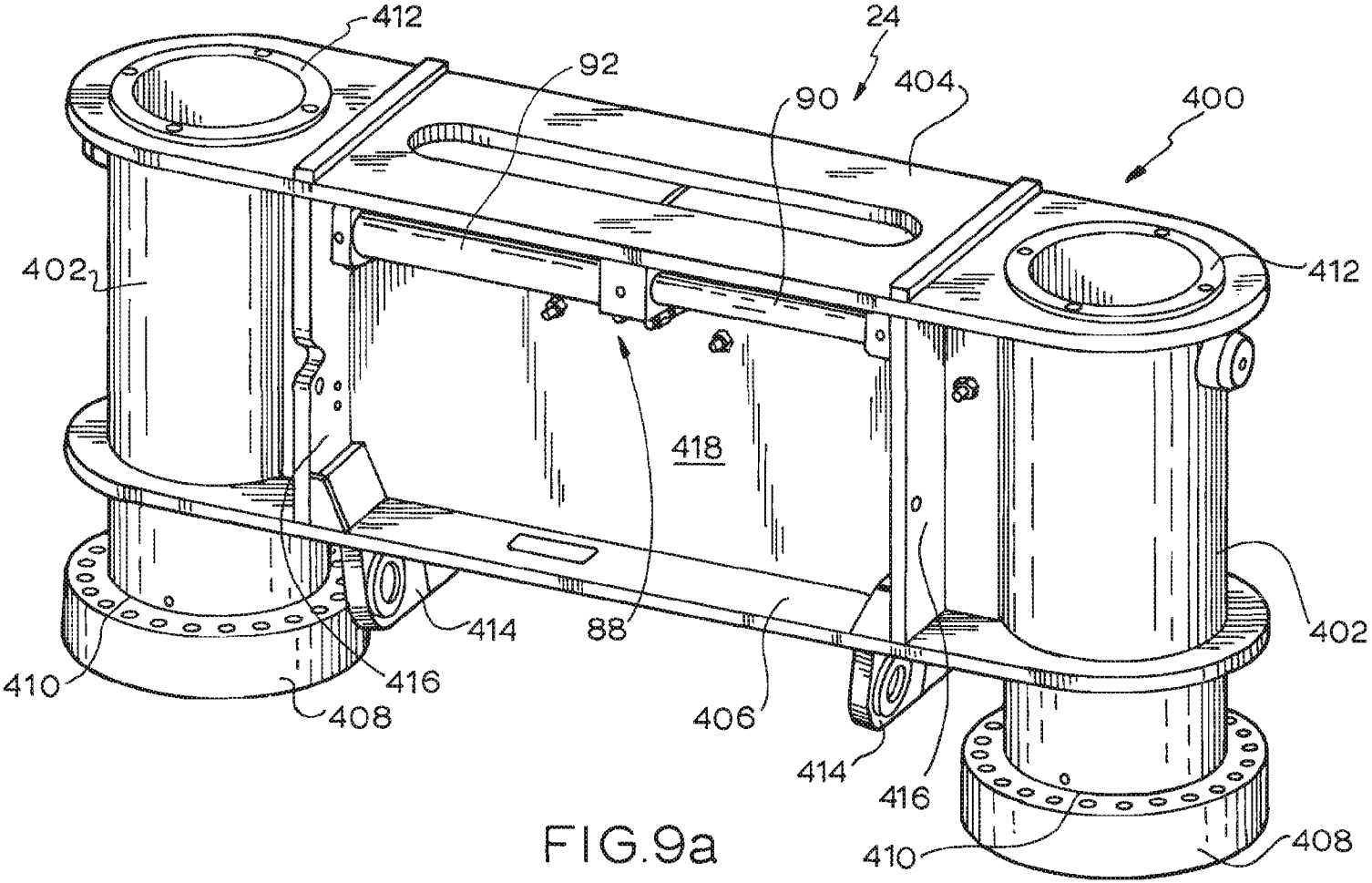
FIG. 9*a* is a perspective view of an intermediate section of the frame of said apparatus shown in FIGS. 1-6.
Figure 9B:
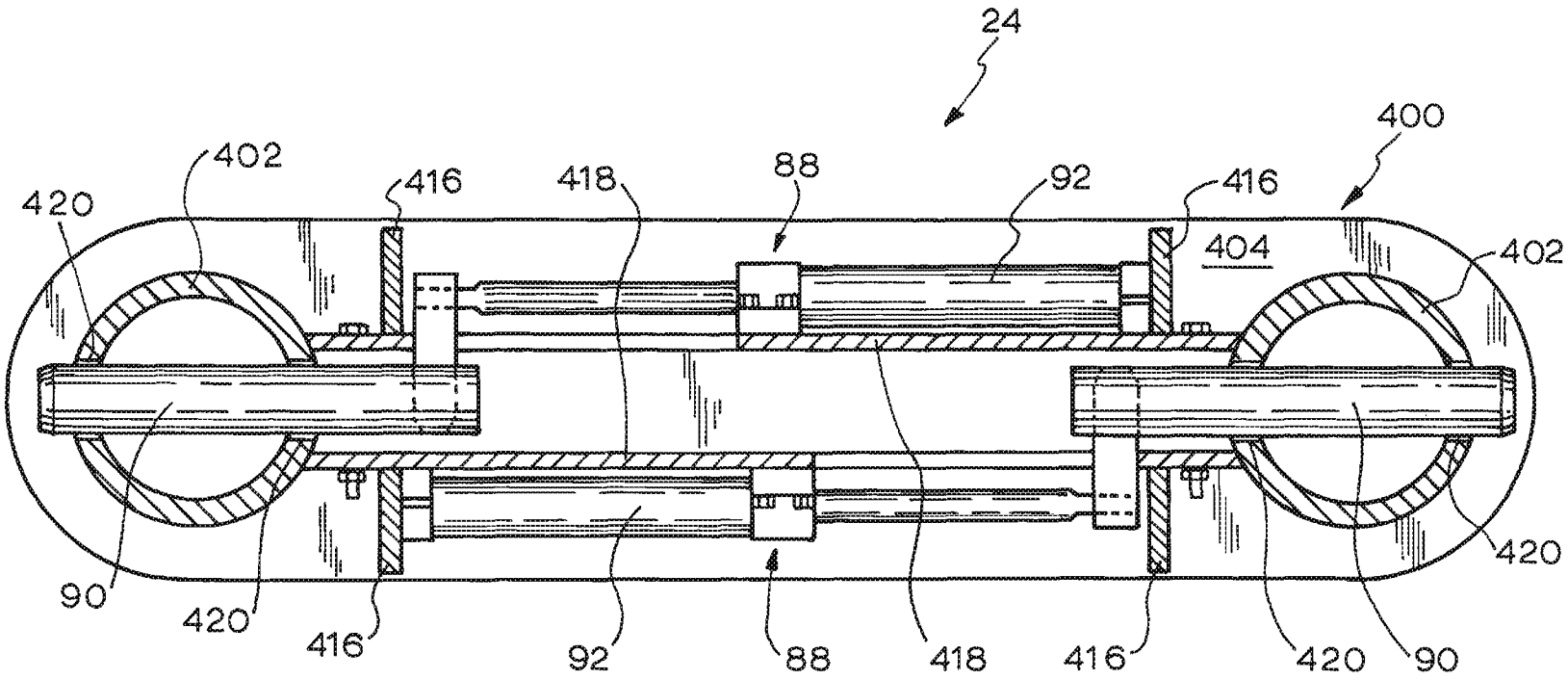
FIG. 9*b* is a plan view of the intermediate section of the frame shown in FIG. 9*a*; and, FIG. 10 is a partial schematic representation of a derrick and drill floor of a floating vessel showing a heave compensation and tensioning apparatus in accordance with an alternative embodiment configured in-line with various components used in locked-to-bottom operations for oil and gas reserves offshore.

Referring now to FIGS. 9*a* and 9*b*, there is shown detailed perspective and plan views of the intermediate section 24 of the frame 12 of the heave compensating and tensioning apparatus 10.

The intermediate section 24 comprises a cross member 400 in the form of a spreader beam. The cross member 400 comprises a pair of spaced apart hollow cylindrical members 402 interconnected by an upper flange plate 404 and a lower flange plate 406.

The cylindrical members 402 are each provided with a flange 408 concentrically disposed at a lower end 410 thereof. The cylindrical members 402 are spaced apart from one another such that the flanges 408 are configured, in use, to receive and couple with respective upper ends of the cylinders 14 so that the piston rods of the cylinders 14 may reciprocally translate concentrically within the hollow cylindrical members 402. In this way, the intermediate member 400 provides structural rigidity to the frame 12.

Figure 3:
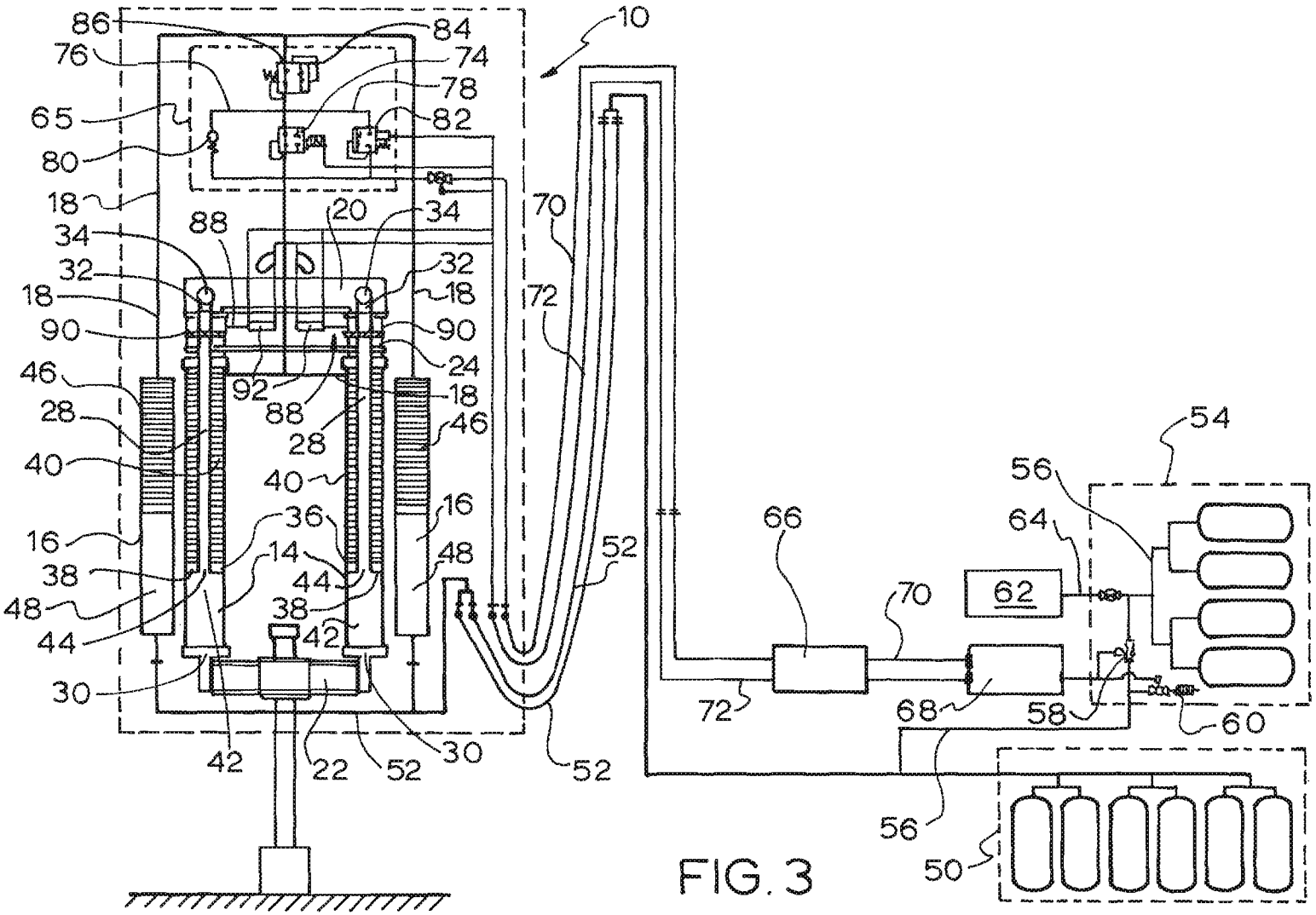
FIG. 3 is a schematic representation of the heave compensating and tensioning apparatus for a floating vessel, wherein the apparatus is mechanically locked for landing.

The upper flange plate 404 is disposed at respective upper ends 412 of the hollow cylindrical members 402. In use, when the piston rods are fully retracted, the upper flange plate 404 provides a landing for the upper section 20 of the frame 12, as shown in FIG. 3.

The lower flange plate 406 may be spaced from the respective lower ends 410 of the hollow cylindrical members 402. The lower flange plate 406 may be provided with a pair of load bearing lugs 414, in the form of padeyes. The load bearing lugs 414 downwardly extend from the lower flange plate 406. Advantageously, the load bearing lugs 414 may be used to lift the frame 12.

A pair of spaced apart vertical brace members 416 may extend between the upper and lower flange plates 404, 406 to provide stiffening. Additionally, a pair of parallel wall members 418 may extend between the upper and lower flange plates 404, 406 and the hollow cylindrical members 402. A mechanical locking mechanism 88 may be mounted to each of the parallel wall members 418. Co-extensively disposed with respect to the mechanical locking mechanism 88 are respective apertures (420) in the hollow cylindrical members 402. The apertures 420 are configured, in use, to receive the locking pin 90 actuated by the hydraulic cylinders 92 of the mechanical locking mechanism 88.

The locking pin 92 is arranged, in use, to engage the clevis 34 of the piston rods 28 when they are fully retracted. It is envisaged that the mechanical locking mechanism 88 may be employed to actuate the locking pin 90 and mechanically lock the piston rods 28 of the cylinders 14 in a fully retracted position when the apparatus 10 is being installed in the derrick 100 and/or when lowering and landing out completions casing/production tubing. Subsequently, the mechanical locking mechanism 88 may be employed to retract the locking pin 90, thereby allowing the piston rods 28 of the cylinders 14 to telescopically translate within the hollow cylindrical members 402.

In use, the heave compensating and tensioning apparatus 10 may be employed as a back up compensator for a primary compensator in the form of a drill string compensator. The heave compensating and tensioning apparatus 10 may be installed by first fully retracting the piston rods 28 of the cylinders 14 within the cylinder barrels 26 and then employing the mechanical locking mechanism 88 to actuate the locking pin 90 into an extended position so that the piston rods 28 are prevented from translating by said pin 90. The upper frame section 20 may then be coupled to the top drive system 120 by various couplers, such as bail arms or elevator links. The flowhead assembly 130 may then be interfaced with the lower section 22 by coupling the flowhead assembly 130 with the split inserts 314 and the collar member 304 proximal to the lower edge 306 of the cylindrical member 302.

When the apparatus 10 is located between the top drive system 120 and the flow head assembly 130, the mechanical locking mechanism 88 may be actuated to withdraw the locking pin 90 so that the piston rod 28 is capable of freely translating within the cylinder barrel 26. The isolation valve 74 of the control assembly 65 is then engaged to hydraulically lock the piston rods 28 at a desired point along their stroke path, thereby forming a rigid link between the top drive system 120 and the flow head assembly 130. In this hydraulically locked configuration, the apparatus 10 is primed to rapidly activate if and when the rig's drill string compensator fails.

In the event of the rig's drill string compensator failing, the pressure in the cylinders 14 may increase in an up heave of the vessel reaching an upper pressure threshold and, conversely, the pressure in the cylinders 14 may decrease in a down heave of the vessel reaching a lower pressure threshold. In response thereto, the control assembly 65 redirects fluid flow to bypass the isolation valve 74 via the first bypass line 78 or the second bypass line 76, respectively, thereby allowing the piston rods 28 to translate freely in the cylinders 14 to retract and extend in response to, and to compensate for, heave of the vessel.

It will also be appreciated that the heave compensating and tensioning apparatus 10 described herein may function as the primary heave compensation system for a floating drilling vessel.

Numerous variations and modifications will suggest themselves to persons skilled in the relevant art, in addition to those already described, without departing from the disclosure. All such variations and modifications are to be considered within the scope of the disclosure.

Figure 10:
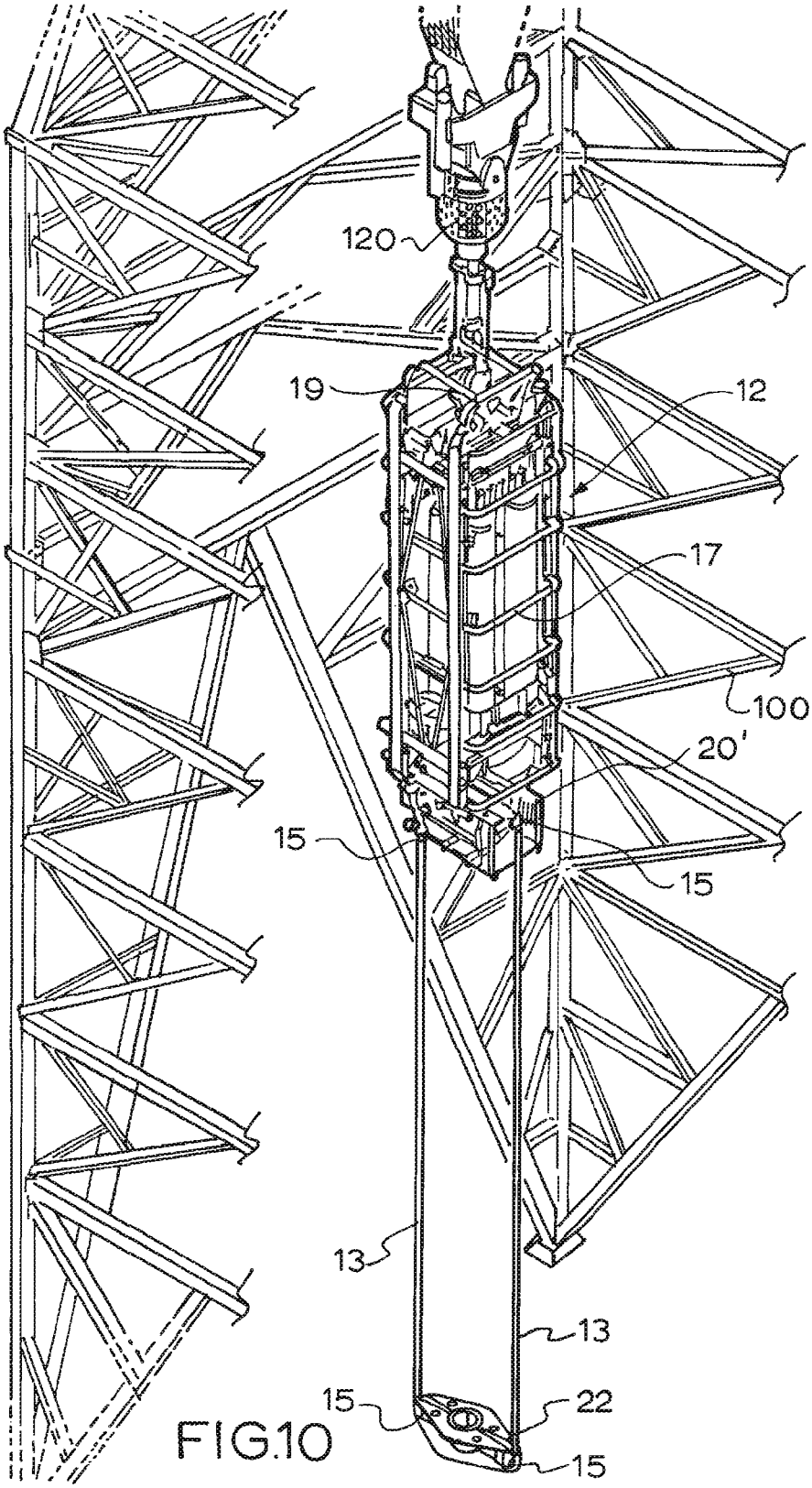

For example, an alternative embodiment of the heave compensating and tensioning apparatus 10' is shown in FIG. 10. The heave compensating and tensioning apparatus 10' is similar to the heave compensating and tensioning apparatus 10 shown in FIGS. 1-9 but differs in several respects, in particular the location of the cylinders 14 and gas accumulators 16 relative to the upper and lower frame members 20, 22, respectively. Accordingly, in the following description of apparatus 10' like numerals will refer to like parts throughout.

The apparatus 10' includes a rigid frame 12', a cylinder 14 in the form of a hydraulic cylinder, and a piston accumulator 16 in operative communication with the cylinder 14 via a primary hydraulic line 18.

The rigid frame 12' includes an upper section 20' and a lower section 22 adapted to interface with the flowhead assembly 130, as described previously. The frame 12' also includes a pair of parallel rigid rods 13 interconnecting respective opposing ends 15 of the upper section 20' and the lower section 22.

In contrast to apparatus 10, the upper section 20' of the frame 12' is not adapted to interface the top drive system 120. Rather, the upper section 20' of the frame 12' is adapted to support thereabove a cage-like structure 17. The cage-like structure 17 houses the cylinder 14 and the piston accumulator 16 and auxiliary peripherals associated therewith, such as the air pressure vessel 50. Advantageously, this particular arrangement reduces the area of deck space occupied by the apparatus 10'

The cylinder 14 is mounted on the upper section 20' of the frame 12'. The cylinder 14 is as otherwise described in the preceding description except that the free end 32 of the piston rod 28 may be adapted for attachment to the top drive system 120. Preferably, the adaptation of the free end 32 may take the form of a pair of opposing downwardly inclined ears 19. In use, as shown in FIG. 10, respective lower ends of the bail arms are engaged with the downwardly inclined ears 19 while respective upper ends of the bail arms are coupled to the top drive system 120.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The invention claimed is:

1. A heave compensation and tensioning apparatus for a floating vessel, said apparatus comprising:

one or more cylinders, each cylinder having a respective cylinder barrel, and a piston head and a piston rod therein, a free end of the one or more piston rods being operatively associated with a top drive system of the floating vessel and a fixed end of each cylinder barrel being fixed relative to a flowhead assembly;

one or more piston accumulators;

a primary hydraulic fluid line interconnecting the one or more piston accumulators and the one or more cylinders;

a control valve assembly arranged to control fluid flow through the primary hydraulic fluid line and thereby retract or extend the one or more piston rods in response to, and to compensate for, heave of the floating vessel, the control valve assembly further comprising an isolation valve capable of locking the one or more piston rods at any point along their respective stroke path, thereby forming a rigid link between the top drive system and the flowhead assembly when said apparatus is operated as a back up to a primary compensator;

the primary hydraulic fluid line being further provided with a bypass fluid flowpath comprising a first bypass line and a second bypass line, each bypass line being configured to bypass the isolation valve, whereby the control valve assembly is configured to redirect fluid flow through the first bypass line when pressure in the cylinder exceeds an upper pressure threshold and through the second bypass line when pressure in the cylinders falls below a lower pressure threshold, thereby allowing the apparatus to continue to compensate for heave of the floating vessel.

2. The apparatus according to claim 1, wherein the piston accumulator comprises a cylinder barrel having a hydraulic chamber and a pneumatic chamber defined therein.

3. The apparatus according to claim 2, wherein the pneumatic chamber is in communication with a pneumatic pressure vessel via a pneumatic fluid line.

4. The apparatus according to claim 3, wherein the primary hydraulic fluid line interconnects the hydraulic chamber(s) of the piston accumulator(s) and the cylinder(s).

5. The apparatus according to claim 2, wherein the primary hydraulic fluid line interconnects the hydraulic chamber(s) of the piston accumulator(s) and the cylinder(s).

6. The apparatus according to claim 1, wherein the primary hydraulic fluid line is further provided with an anti-recoil flow shut-off valve having an integral restricted flow path, whereby under sudden loss of load the anti-recoil valve is configured to close and to redirect the flow of hydraulic fluid through the restricted flow path within the valve.

7. The apparatus according to claim 6, wherein sudden loss of load is indicated by an acceleration and velocity of the one or more piston rods relative to their respective cylinder barrels.

8. The apparatus according to claim 7, wherein the valve is triggered to close when the one or more piston rods accelerate relative to their respective cylinder barrels to a velocity exceeding the maximum normal heave velocity of the vessel.

9. The apparatus according to claim 1, wherein each piston rod is hollow and in fluid communication with a respective blind side of the cylinder via an aperture in the piston head, each hollow piston rod thereby defining a gas accumulator therein to accommodate fluctuation in gas pressure in the blind side of the cylinder when the piston rod retracts or extends in response to, and to compensate for, heave of the floating vessel.

10. A method of activating a back-up compensator to provide heave compensation for a floating vessel equipped with a primary compensator when said primary compensator fails, the method comprising:

providing the back-up compensator according to claim 1;

locating the one or more cylinders of the back-up compensator between the top drive system and the flow head assembly in a manner whereby the free ends of the piston rods are operatively associated with the top drive system and the fixed ends of the cylinders are fixed relative to the flow head assembly;

locking the isolation valve of the back-up compensator to form a rigid link between the top drive system and the flow head assembly when said primary compensator is functioning;

when said primary compensator fails thereby causing the pressure in the one or more cylinders to exceed an upper pressure threshold or fall below a lower pressure threshold, redirecting fluid flow to bypass the locked isolation valve via the first bypass line or the second bypass line, respectively; and, allowing the piston rods of the one or more cylinders to retract or extend in response to, and to compensate for, heave of the floating vessel.

11. A heave compensation and tensioning apparatus for a floating vessel, said apparatus comprising:

a frame having an upper section adapted for attachment to a top drive system and a lower section adapted to interface with a flowhead assembly;

a pair of cylinders fixed to the lower section of the frame, each cylinder having a piston head and a piston rod therein, a free end of the piston rod being operatively associated with the upper section of the frame;

a pair of piston accumulators;

a primary hydraulic fluid line interconnecting the piston accumulators and the cylinders;

a control valve assembly arranged to control fluid flow through the primary hydraulic fluid line and thereby retract or extend the piston rods in response to, and to compensate for, heave of the floating vessel, the control valve assembly further comprising an isolation valve capable of locking the piston rods at any point along their respective stroke path, thereby forming a rigid link between the top drive system and the flow head assembly when said apparatus is operated as a back up to a primary compensator;

the primary hydraulic fluid line being further provided with a bypass fluid flowpath comprising a first bypass line and a second bypass line, each bypass line being configured to bypass the isolation valve, whereby the control valve assembly is configured to redirect fluid flow through the first bypass line when pressure in the cylinders exceeds a upper pressure threshold and through the second bypass line when pressure in the cylinders falls below a lower pressure threshold, thereby allowing the apparatus to continue to compensate for heave of the floating vessel.

12. A heave compensation and tensioning apparatus for a floating vessel, said apparatus comprising:

a frame having an upper section and a lower section adapted to interface with a flowhead assembly;

a cylinder fixed to the upper section of the frame, the cylinder having a piston head and a piston rod therein, a free end of the piston rod being adapted for attachment to a top drive system;

a piston accumulator;

a primary hydraulic fluid line interconnecting the piston accumulator and the cylinder;

a control valve assembly arranged to control fluid flow through the primary hydraulic fluid line and thereby retract or extend the piston rod in response to, and to compensate for, heave of the floating vessel, the control valve assembly further comprising an isolation valve capable of locking the piston rod at any point along its respective stroke path, thereby forming a rigid link between the top drive system and the flow head assembly when said apparatus is operated as a back up to a primary compensator;

the primary hydraulic fluid line being further provided with a bypass fluid flowpath comprising a first bypass line and a second bypass line, each bypass line being configured to bypass the isolation valve, whereby the control valve assembly is configured to redirect fluid flow through the first bypass line when pressure in the cylinder exceeds a upper pressure threshold and through the second bypass line when pressure in the cylinder falls below a lower pressure threshold, thereby allowing the apparatus to continue to compensate for heave of the floating vessel.

* * * * *